US006155422A

United States Patent [19]

Kaminski

[11] Patent Number: 6,155,422

[45] Date of Patent: Dec. 5, 2000

[54] PAPERBOARD BOX WITH CONTENT VOLUME DISPLAY WINDOW SYNTHESIZER DEVICE

[76] Inventor: Nicholas Kaminski, 13 Clinton Ct., Kendall Park, N.J. 08824

[21] Appl. No.: 09/384,033

[22] Filed: Aug. 26, 1999

[51] Int. Cl.[7] ..... B65D 85/00

[52] U.S. Cl. ..... 206/459.5; 206/831; 229/162

[58] Field of Search ..... 206/459.5, 831; 229/162; 40/312

[56] References Cited

U.S. PATENT DOCUMENTS

| | | | |
|---|---|---|---|
| 1,290,386 | 1/1919 | Smith | 229/162 |
| 2,177,918 | 10/1939 | Vogt et al. | 229/162 |
| 3,207,411 | 9/1965 | Farquhar | 219/6 |
| 3,360,119 | 12/1967 | Mullinix | 206/45.31 |
| 3,591,069 | 7/1971 | Heller, Jr. | 229/162 |
| 4,838,424 | 6/1989 | Petzelt | 206/831 |
| 4,925,035 | 5/1990 | Hunninghaus | 206/633 |
| 4,955,469 | 9/1990 | Hudspith | 206/45.23 |
| 5,009,518 | 4/1991 | Faltynek | 206/831 |

*Primary Examiner*—David T. Fidei
*Attorney, Agent, or Firm*—LaMorte & Associates P.C.

[57] ABSTRACT

A paperboard box and the blank used to make the paperboard box. The paperboard box is made from a single cut blank of paperboard. When the blank is folded into a box, the box has a top surface, a bottom surface and a plurality of side surfaces that extend between the top surface and the bottom surface. At least one slot is disposed within one of the side surfaces. A translucent piece of plastic covers each slot from within the paperboard box, therein defining a window. A tear-away section of paperboard material covers the window. The tear-away section of paperboard material exposes the window when removed. The tear-away section can be on the same section of paperboard as the window or can be on a separate section of paperboard that lays over the window.

9 Claims, 3 Drawing Sheets

PAPERBOARD BOX WITH CONTENT VOLUME DISPLAY WINDOW SYNTHESIZER DEVICE

BACKGROUND OF THE INVENTION

1. Field of the Invention

In general, the present invention relates to storage boxes that are used to hold commercially sold food products, such as cereal. More particularly, the present invention relates to paperboard boxes that contain a translucent window so that the volume of the contents of the box can be ascertained by a visual inspection.

2. Description of the Prior Art

Many food products are sold in paperboard boxes. Paperboard boxes have many advantages that make the paperboard box the packaging of choice for many food products, such as cereal, crackers, pasta and the like. Paperboard boxes are inexpensive and provide good protection to the food product within the box. This is important with food products, such as cereal and crackers, that are easily damaged. The paperboard box is also easy to print upon, thereby providing a medium by which a manufacturer can visually distinguish its product from others. In highly competitive markets, such as cereal, manufacturers produce sophisticated graphical designs on their boxes to make the cereal more appealing to a consumer. Therefore, paperboard boxes are preferred by manufacturers because they provide a much more attractive marketing package than would a plastic bag.

Despite its many advantages, paperboard boxes are not without their disadvantages. One disadvantage of using a paperboard box is that it cannot be hermetically sealed. As such, plastic bags are used within the box to further protect the food product and ensure freshness. Another disadvantage of the paperboard boxes is that they are opaque. Consequently, the contents of the paperboard box cannot be viewed until the box is opened.

In a typical household, groceries are stored in a kitchen cabinet or cupboard. Food products that are packaged in boxes, such as cereal, are commonly placed directly in the cabinet. As such, when a person needs to assess how much cereal is left within a particular cereal box, that person must either shake the box or open the box to view its contents. When a person is assessing his/her needs prior to grocery shopping, that person must often shake and/or open numerous boxes to assess what food is in short supply and in need of replacement.

In the prior art, many different paperboard box designs have been developed that enable a person to view at least part of the contents of that box. Many of these prior art box designs are exemplified by U.S. Pat. No. 4,955,469 to Hudspith, entitled Covertable Container. In the Hudspith patent, a paperboard box is shown that contains an open aperture. A piece of clear plastic is glued over the aperture, thereby producing a clear window through which the contents of the box can be viewed. In the prior art, the shape and location of the clear window in the paperboard box come in hundreds of different variations.

A problem with putting a clear window on a paperboard box is that the clear window detracts from the integrity of the box. The paperboard box is therefore less likely to protect the food within the box from being crushed or being exposed to ambient air. A need therefore exists for an improved paperboard box design that contains a window for viewing the contents of that paperboard box yet is positioned in a manner that does not detract from the integrity of the paperboard box. This need is met by the present invention system and method as described and claimed below.

SUMMARY OF THE INVENTION

The present invention is a paperboard box and the blank used to make the paperboard box. The paperboard box is made from a single cut blank of paperboard. When the blank is folded into a box, the box has a top surface, a bottom surface and a plurality of side surfaces that extend between the top surface and the bottom surface. At least one slot is disposed within one of the side surfaces. A translucent piece of plastic covers each slot from within the paperboard box, therein defining a window.

A tear-away section of paperboard material covers the window. The tear-away section of paperboard material exposes the window when removed. The tear-away section can be on the same section of paperboard as the window or can be on a separate section of paperboard that lays over the window.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention paperboard box device can be configured into many different types of boxes, such as a cracker box or a cookie box, the present invention device is particularly well suited for use as a cereal box. Accordingly, the illustrated examples of the present invention system will show an application where the paperboard box is configured as a cereal box. However, it should be understood that the described paperboard box design can be adapted to boxes having many different purposes and a variety of shaped configurations.

Figure 1:
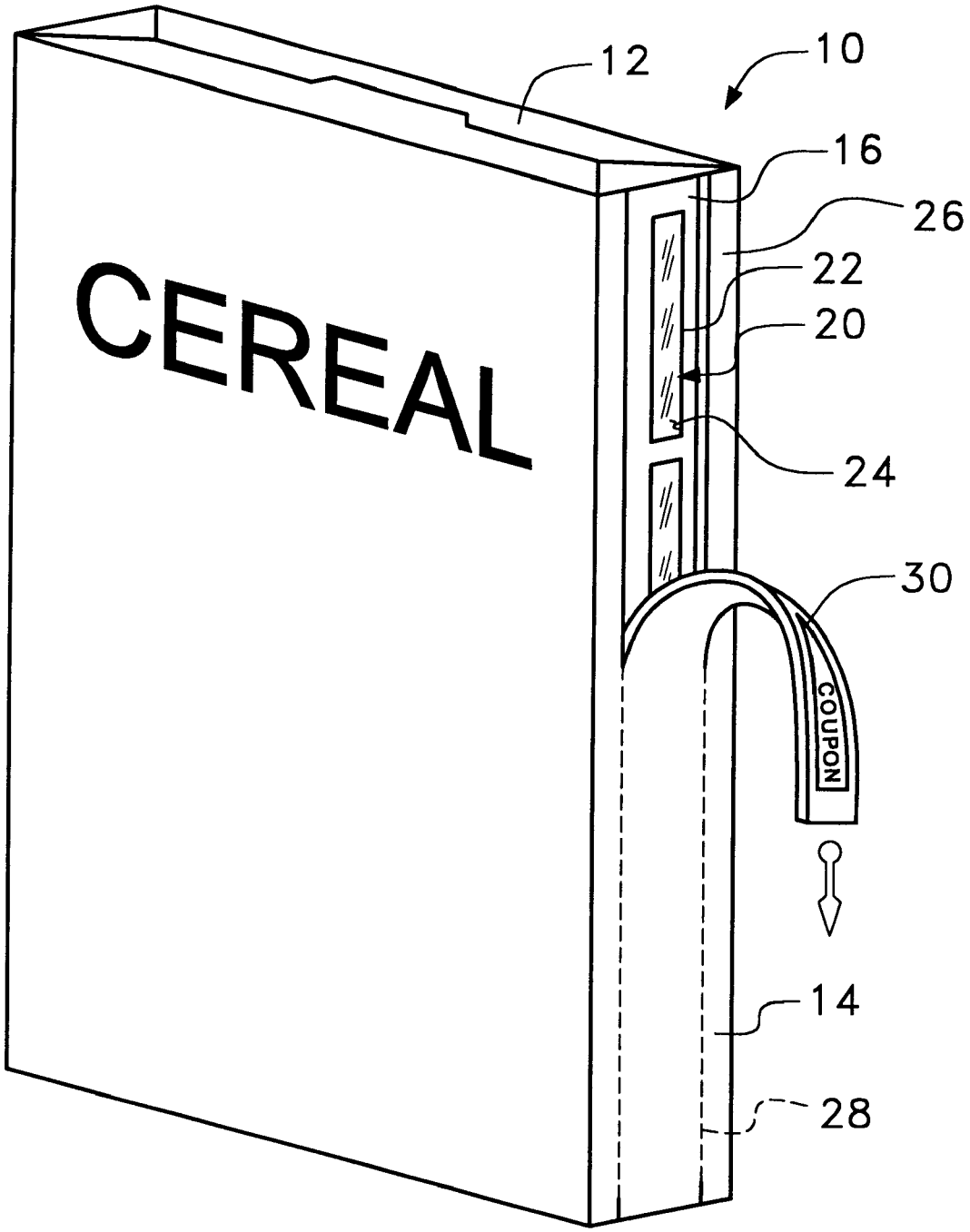
FIG. 1 is a perspective view of a paperboard cereal box made in accordance with the present invention.

Referring to FIG. 1, an exemplary embodiment of a paperboard box 10 is shown. The paperboard box 10 is configured as a traditional cereal box, wherein the paperboard box 10 is rectangular in shape and has two vertical face surfaces joined by two side surfaces, a top surface and a bottom surface. The paperboard box 10 has a top surface 12 that is openable in the traditional manner to access any cereal that is held within the paperboard box 10.

The novelty of the shown paperboard box 10 is contained in the structure of one of the vertical side surfaces 14 of the paperboard box 10. Traditionally, each surface of a paperboard box is made from a single layer of paperboard. The degree of overlap between sections of paperboard is limited to the requirements necessary for folding and gluing. In the embodiment of FIG. 1, the vertical side surface 14 of the paperboard box 10 is made from two fully overlapping sections of the paperboard material.

The underlying inner section 16 of paperboard material on the vertical side surface 14 of the paperboard box 10, contains a long narrow window 20 that runs nearly the entire height of the box. The window 20 can be a continuous window or a plurality of smaller aligned windows, such as is shown. The window 20 is made by slots 22 in the material of the paperboard box 10 that are covered with a clear piece of plastic 24.

The outer section 26 of paperboard material on the vertical side surface 14 of the paperboard box 10, completely covers the inner section 16. The outer section 26 of paperboard material contains perforations 28 that define a tear-away segment 30. The outer section 26 of the paperboard material is glued to the inner section 16 in areas surrounding the area of the tear-away segment 30. Accordingly, the outer section 26 of the paperboard material reinforces the inner section 16 of paperboard material and the integrity of the overall box 10 is in no manner compromised by the presence of the window 20.

The tear-away segment 30 of the outer section 26 covers the windows 20, thereby preventing the windows 20 from being damaged during the shipping, display and transportation of the paperboard box 10 with its contents. When a customer buys a food product in the paperboard box 10 and brings that product home, the person can remove the tear-away segment 30 of the outer section 26 from the vertical side 14 of the box 10. Once the tear-away segment 30 of the outer section 26 is removed, the windows 20 on the inner section 16 are exposed.

The windows 20 on the inner section 16 of the paperboard box 10 provide a means through which a person can visually inspect the contents of the box 10 without having to touch the box 10. As such, by viewing the windows on the vertical side surface 14 of the box 10, a person can see the material within the box 10 and can assess the level of that material in the box 10. Accordingly, a person can tell if a cereal box is near full or near empty without having to touch the cereal box.

The windows 20 on the paperboard box 10 are narrow, preferably being less than one half inch in width. The windows 20 also extend along at least eighty percent of the overall length of the vertical side surface 14. The narrowness of the windows 50 helps prevent the windows 20 from being damaged and rendering the box unusable. The use of multiple aligned windows rather than one long window is preferred to help reinforce the integrity of the vertical side surface 14 of the box 10. Smaller windows are also less likely to become damaged as opposed to one large single window.

The tear-away segment 30 of the outer section 26 that covers the windows 20 is made to be easily removable. The tear-away segment 30 itself is also highly useful in that it provides cereal manufacturers added space to print coupons, proof of purchase coupons, sweepstakes prizes and the like. Since the tear-away segment 30 of the paperboard box 10 can be removed without damaging the integrity of the box, coupons no longer need to be cut from an empty box and printed sweepstakes prizes no longer need to be placed inside the packaging of the box.

Figure 2:
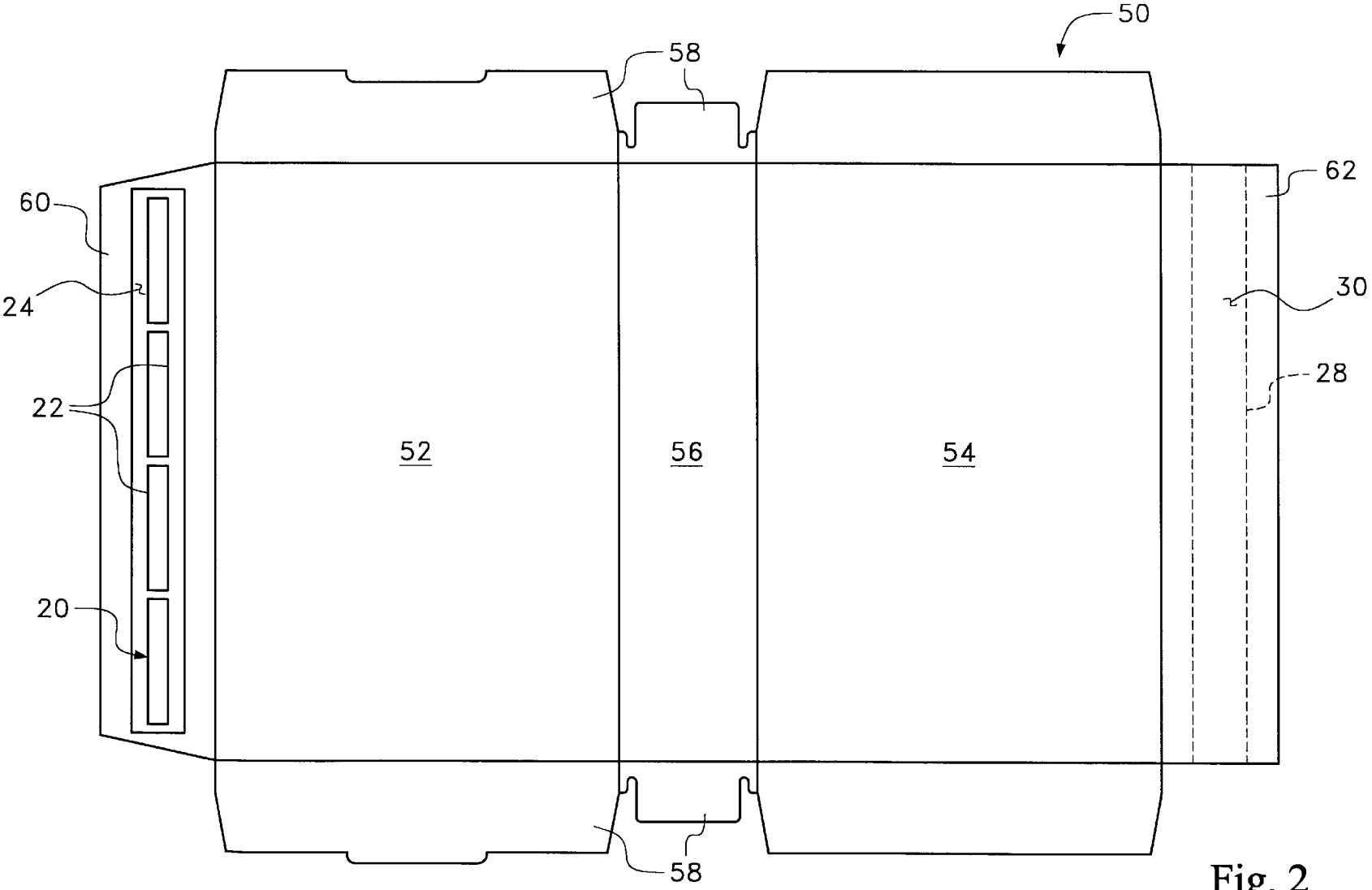
FIG. 2 is front view of a blank used to create the paperboard box of FIG. 1.

Referring to FIG. 2, the blank 50 for the paperboard box 10 (FIG. 1) is shown. The blank 50 is unistructural and cut from a single piece of paperboard material. The blank 50 contains two large rectangular sections 52, 54, which become the front and rear vertical faces of the paperboard box. The two rectangular sections 52, 54 are joined by a middle section 56, which becomes one of the vertical side surfaces of the paperboard box. Flaps 58 extend from both sides of the large rectangular sections 52, 54 and the middle section 56. The flaps interfold to create the top and bottom of the paperboard box.

A first side flap 60 extends from the first rectangular section 52. The first side flap 60 becomes the inner section 16 (FIG. 1) of the vertical side wall shown previously in FIG. 1. Slots 22 are disposed in the first side flap 60. As has been previously mentioned, the slots 22 are aligned and have a width of less than one half inch. A piece of clear plastic 24 is placed over the slots 22. The clear plastic 24 is glued to the first side flap 60 around the periphery of the slots 22, therein forming the window 20 previously described.

A second side flap 62 extends from the second rectangular section 54 of the blank 50. The second side flap 62 becomes the outer section 26 (FIG. 1) of the vertical side wall shown in FIG. 1. When the paperboard box is folded, the second side flap 62 folds over the first side flap 60, thereby covering the windows 20. Perforations 28 are disposed in the second side flap 62. The perforations 28 define the tear-away segment 30 that lays across windows 20. When the tear-away segment 30 is removed, the windows 20 become exposed.

In many cereal boxes, the cereal is stored within a plastic bag within the confines of a paperboard box. It should be understood that the clear plastic 24 covering the slots 22 in the first side flap 60 is optional. The plastic bag used to hold the cereal can itself be glued to the interior of the first flap section 60 over the slots 22. The material of the plastic bag itself therefore becomes the cover for the slots 22.

Figure 3:
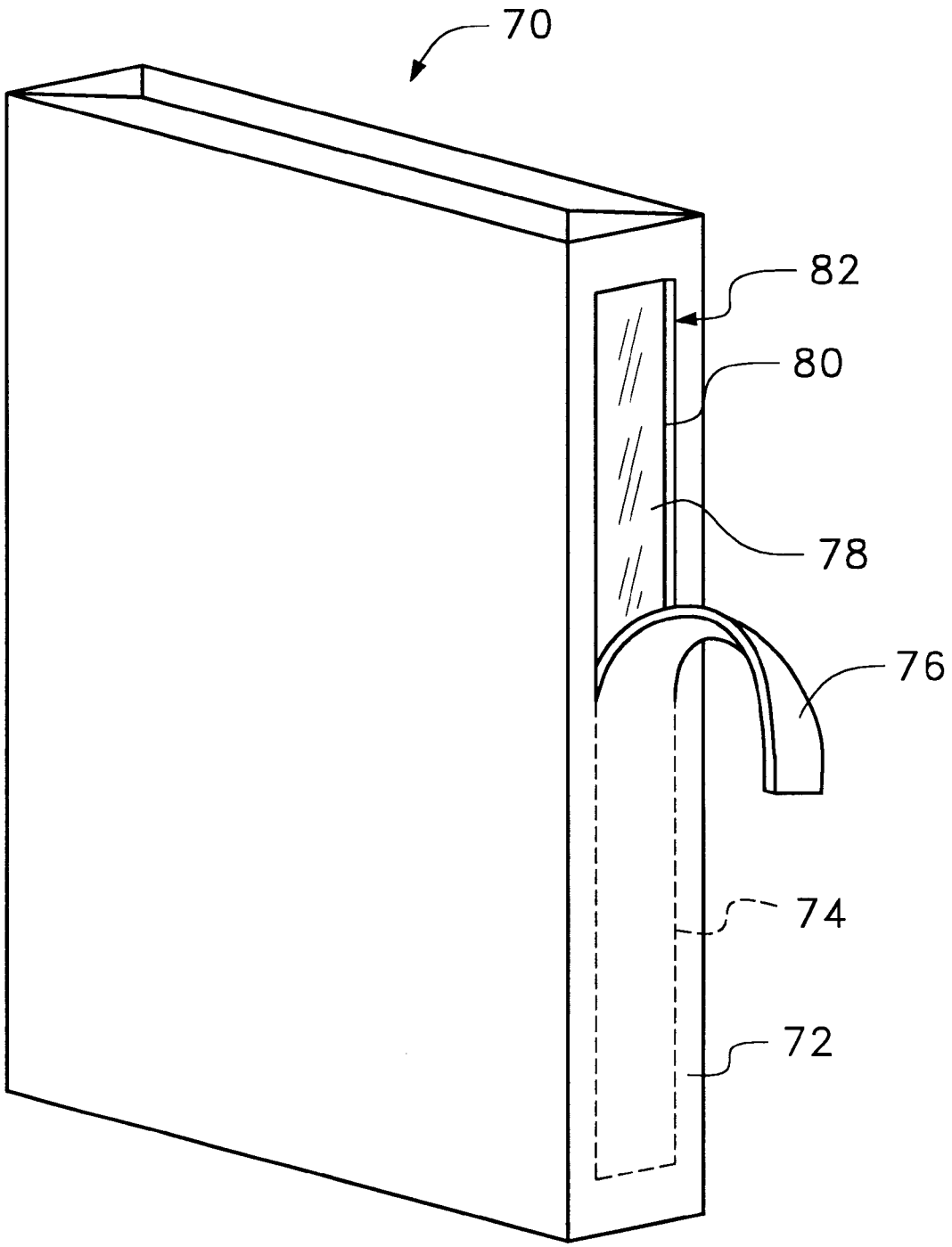
FIG. 3 is a perspective view of an alternate embodiment of a paperboard box in accordance with the present invention.

Referring now to FIG. 3, an alternate embodiment of a paperboard box 70 is shown. In this embodiment, a single section of paperboard material is used to create the vertical side 72 of the box 70. Perforations 74 are present on the vertical side 72 of the box 70 that define a tear-away section 76. The tear-away section 76 has a height that extends along at least eighty percent of the vertical side 72 of the box 10. The width of the tear-away section 76 is between one eighth of an inch and one half of an inch. A piece of clear plastic 78 is glued to the inside of the vertical side 72 of the box 70 around the periphery of the tear-away segment 76. When the tear-away segment 76 is removed, the resulting slot 80 is sealed internally by the piece of clear plastic 78. Accordingly, when the tear-away segment 76 is removed, a window 82 is created that enables a person to see at what level the paperboard box 70 is full.

The tear-away segment 76 is not removed from the paperboard box 70 until a consumer purchases the product and takes the paperboard box 70 home. Accordingly, the integrity of the paperboard box 70 is maintained while the food product in the paperboard box 70 is being transported to a grocer, displayed at the grocer and transported home from the grocer. Once the product is taken home, the tear-away segment 76 is removed, and the paperboard box 70 maintains sufficient integrity for use in common household storage.

It will be understood that the embodiments of the present invention described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. A paperboard box, comprising:

a top surface, a bottom surface and a plurality of side surfaces that extend a predetermined length between said top surface and said bottom surface, wherein said plurality of side surfaces include a first side surface and a last side surface that overlap and are adhered together when forming said box;

a plurality of slots disposed within said first side surface, each of said plurality of slots being linearly aligned with one another, wherein said plurality of slots combine to extend across at least eighty percent of said predetermined length of said first side surface;

a translucent piece of plastic covering said plurality of slots on said first side surface;

a tear-away section of paperboard material disposed in said last side surface, said tear-away section covering said plurality of slots, wherein said tear-away section on said last section side surface exposes said plurality of slots on said first side surface when removed.

2. The box according to claim 1, wherein said tear-away section is defined by perforations in said last section of paperboard material.

3. The box according to claim 1, wherein said plurality of slots have a width of no greater than one half of an inch.

4. The box according to claim 1, wherein said tear-away segment has printing thereon and said printing is selected from a group consisting of coupons, sweepstakes entries and proofs of purchase coupons.

5. The box according to claim 1, wherein said paperboard box is a cereal box having two large vertical face surfaces and two narrower side surfaces that interconnect said vertical face surfaces, and wherein said first side surface and said last side surface form one of said narrower side surfaces.

6. A box blank, comprising:

a first face panel having an inner edge, an outer edge, a top surface and a bottom surface;

a second face panel having an inner edge, an outer edge, a top surface and a bottom surface;

a middle section joining said inner edge of said first face panel to said inner edge of said second face panel;

a first side flap extending from said outer edge of said first face panel, said first side flap having a predetermined length, wherein a plurality of linearly aligned slots are disposed in said first side flap and said plurality of slots combine to extend across at least eighty percent of said predetermined length;

a piece of translucent plastic attached to said first side flap and covering said plurality of slots;

a second side flap extending from said outer edge of said second face panel, wherein said second side flap contains perforations that define a tear-away section;

wherein said second side flap overlaps said first side flap when said blank is folded into a box and said tear-away section lays over said plurality of slots.

7. The blank according to claim 6, wherein said slot has a width of no greater than one half of an inch.

8. The blank according to claim 6, wherein said tear-away segment has printing thereon and said printing is selected from a group consisting of coupons, sweepstakes entries and proofs of purchase coupons.

9. The blank according to claim 6, wherein said plurality of slots are separated by reinforcement elements at periodic positions.

* * * * *